United States Patent [19]

Bertetto et al.

[11] 4,121,359

[45] Oct. 24, 1978

[54] APPARATUS FOR RELEASABLY MOUNTING CLOSURE BUCKLES TO SKI BOOTS

[75] Inventors: Donald W. Bertetto; Chris A. Hanson, both of Boulder, Colo.

[73] Assignee: Hanson Industries Incorporated, Boulder, Colo.

[21] Appl. No.: 778,751

[22] Filed: Mar. 17, 1977

[51] Int. Cl.[2] ..... A43B 5/04; A43B 21/00; A43B 11/00; A43C 11/00

[52] U.S. Cl. ..... 36/117; 24/69 SK; 24/70 SK; 36/50; 36/105

[58] Field of Search ..... 24/68 SK, 69 SK, 70 SK, 24/71 SK, 73 GC, 81 SK; 36/117, 50, 105

[56] References Cited

U.S. PATENT DOCUMENTS

| | | | |
|---|---|---|---|
| 3,408,752 | 11/1968 | Lollmann | 36/50 X |
| 3,956,796 | 5/1976 | Guolo | 36/50 X |
| 3,967,391 | 7/1976 | Kastinger | 36/50 |

*Primary Examiner*—Patrick D. Lawson
*Attorney, Agent, or Firm*—Merriam, Marshall & Bicknell

[57] ABSTRACT

Apparatus for releasably mounting closure buckles to ski boots, said apparatus including a mounting pad integrally molded with the shell of the boot and having an undercut interior surface for slidably engaging flanges depending from a buckle stand assembly to secure the buckle stand assembly and the closure buckle pivotally mounted therein to the boot. The apparatus further includes a mechanism for releasably latching the buckle stand assembly in position on the mounting pad.

14 Claims, 5 Drawing Figures

FIG. 3
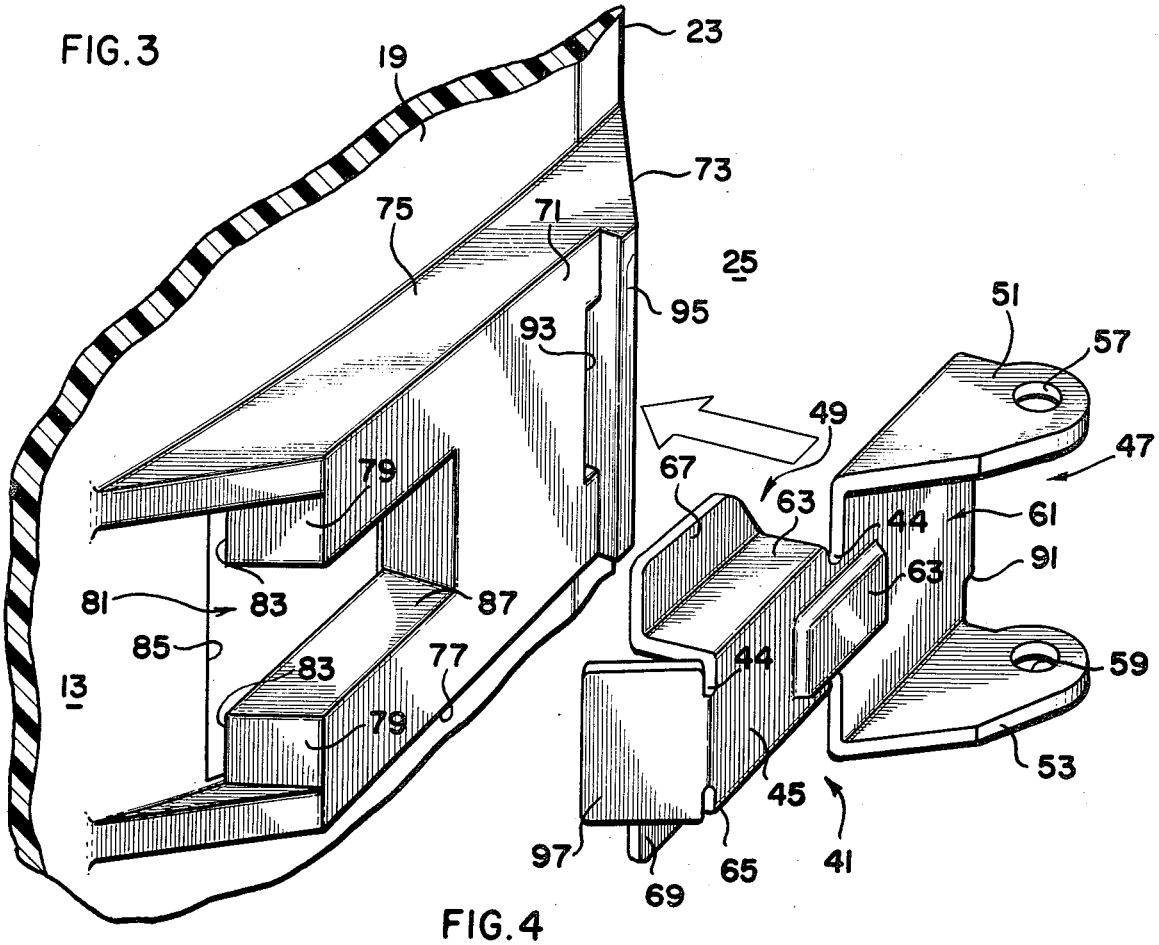
FIG. 4
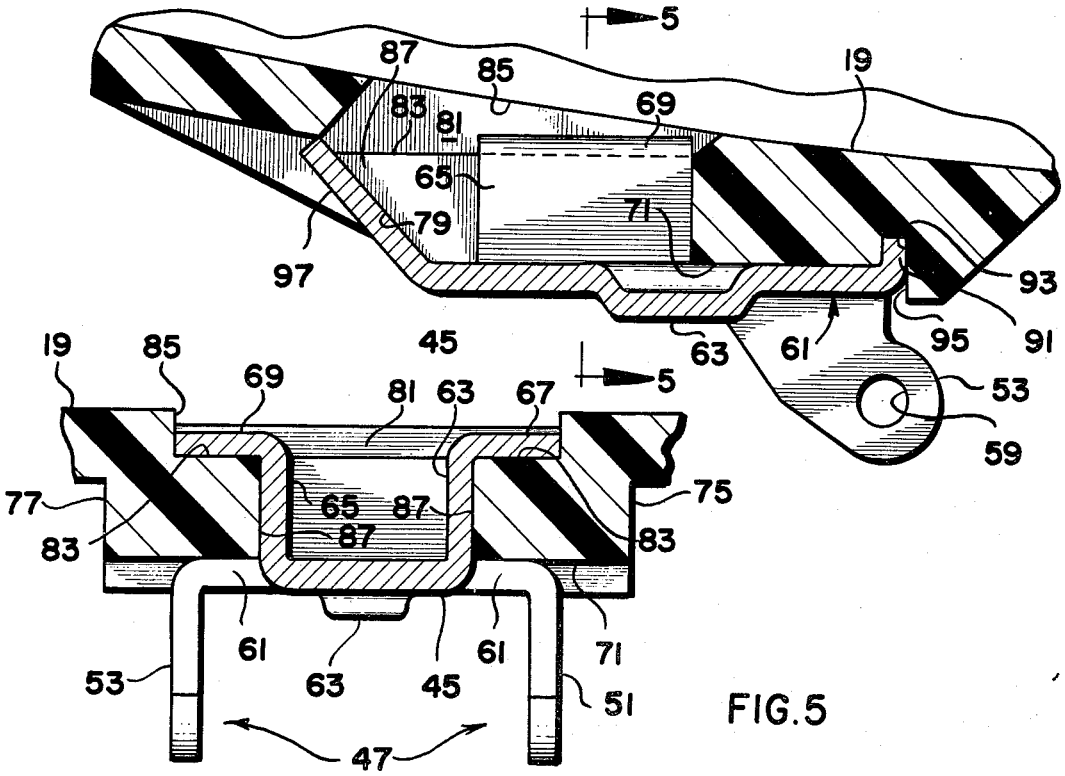
FIG. 5

APPARATUS FOR RELEASABLY MOUNTING CLOSURE BUCKLES TO SKI BOOTS

BACKGROUND OF THE INVENTION

The present invention relates generally to footwear and more particularly to a ski boot of the rear entry type having provision for releasably mounting closure buckles to the boot.

Plastic ski boots of the rear entry type commonly incorporate buckle closure systems for securing the ski boot to the foot of the wearer. One such closure system is shown in U.S. Pat. No. 3,945,135, issued Mar. 23, 1976 and assigned to Hanson Industries Inc., Boulder, Colo. As may be seen by reference thereto, such closure systems include a cable looped through a clamp attached to the boot near one edge of the rear entry opening and an assembly including a buckle on the other side of the rear opening for engaging the cable loop to secure a tongue closing the rear opening in place. The buckle assembly which includes a buckle stand in which the buckle is pivotally mounted heretofore commonly has been riveted to a plastic buckle pad integrally molded with the shell of the boot. Since its introduction, this type of closure system has become extremely popular and has proven to be an effective means for closing ski boots of the rear entry type.

Because the buckle stand on which the buckle is pivoted is riveted to the boot, however, should it become necessary to replace the buckle assembly, care must be taken to remove the old buckle stand without damaging the boot and then mount a new buckle assembly on the boot. The difficulties associated with replacing the buckle assembly have been alleviated by the development of releasable, non-riveted buckle assemblies which have the added advantage of reducing material and labor costs by eliminating the rivet and the manufacturing step required to manually rivet the buckle stand to the ski boot.

One such assembly incorporates a buckle stand comprising a generally U-shaped clip having a pair of opposing, inwardly directed flanges at respective ends thereof for engaging the corresponding outwardly directed flanges of a generally T-shaped lug integrally molded with the boot to mount the stand to the boot. Problems arise, however, in molding the T-shaped lug with the boot. In particular, backdrafts are commonly provided in the ski boot shell molds to provide the undercut portions of the lug, but in removing the molded shell from the molds, the lug flanges tend to hang up in the backdrafts of the mold. This results in minute tears in the molded product which weaken the lug and increase its susceptibility to failure.

SUMMARY OF THE INVENTION

Accordingly, there is hereinafter described and claimed in accordance with the principles of the present invention apparatus for releasably mounting closure buckles to ski boots of the rear entry type which does not exhibit the structural weaknesses heretofore common to releasable buckle mounting apparatus. The releasable buckle mounting apparatus herein provided also has the added advantage of reducing the labor and material cost associated with manufacturing ski boots.

The apparatus of the present invention includes a mounting pad which can be integrally molded with the boot to provide, without the use of molds having backdrafts, a forward undercut interior surface for releasably mounting a buckle stand assembly to said boot. In particular, the buckle stand includes a base having a yoke portion in which the buckle is pivotally mounted and means for mounting the base in slidable engagement with the pad. A slot extends rearwardly in the pad for a distance and from the top mounting surface of the pad through to the interior surface. The buckle stand mounting means comprises a pair of inwardly directed flanges which engage the slot while foot portions of the flanges extend in opposite directions at the ends of the inwardly directed flanges to bear against the interior surface of the pad and secure the base of the buckle stand assembly against the outer mounting surface of the boot pad. The apparatus further includes means comprising a downwardly extending flange depending from the stand base and engaging a shallow slot in the mounting surface of the pad to latch the buckle stand to the pad and prevent its release from the boot during normal use. The stand is selectively released by disengaging the latching flange from the slot and sliding the buckle stand assembly off the pad.

BRIEF DESCRIPTION OF THE DRAWINGS

The features of this invention which are believed to be novel are set forth with particularity in the appended claims. The invention, together with its further objects and advantages thereof, may be best understood, however, by reference to the following description taken in conjunction with the accompanying drawings, in which like reference numerals identify like elements in the several figures and in which:

FIG. 3 is a perspective view showing the releasable buckle mounting apparatus in its disassembled state;

FIG. 4 is a sectional view taken along lines 4—4 of FIG. 2; and

FIG. 5 is a sectional view taken along lines 5—5 of FIG. 4.

DETAILED DESCRIPTION

Figure 1:
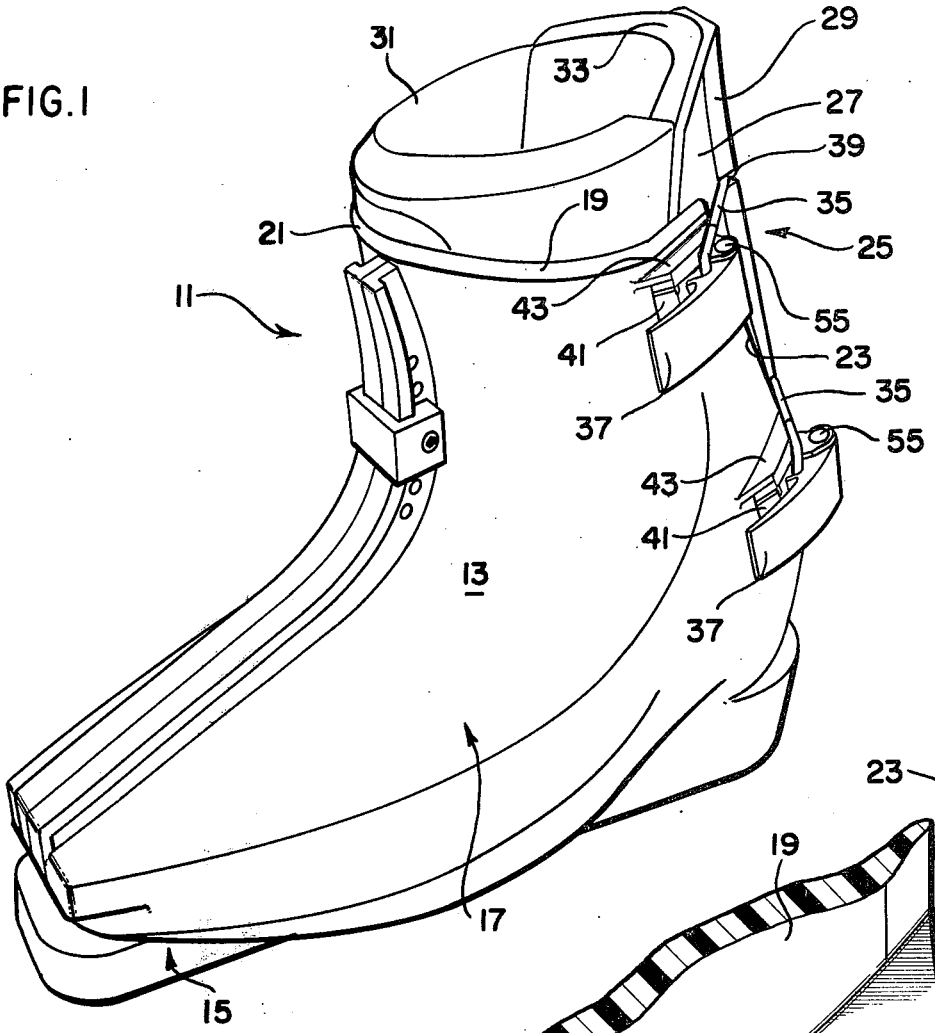
FIG. 1 is a perspective view of a rear entry ski boot incorporating the releasable buckle mounting apparatus of the present invention.

Referring now to the drawings and in particular to FIG. 1, there is shown a plastic rear-entry ski boot 11 which comprises a semi-rigid shell 13 providing a stiff sole 15 adapted to engage ski bindings and an upper vamp 17 for accommodating a wearer's foot. The shell 13 is preferably molded in two complimentary shell portions 19 and 21 and fastened together as described generally in U.S. Pat. No. 3,848,347, issued November 19, 1974 and also assigned to Hanson Industries Inc. In particular, the vamp 17 is closed at the front while the back is open. The rear edges 23 of the shell portions 19 and 21 define a rear opening, identified generally at 25, adapted to receive a vertical tongue member 27 pivotally connected to the shell 13. When in the closed position, the tongue 27 fits within the rear opening 25 of the shell 13 to close said rear opening. Preferably, the tongue 27 is reinforced by a vertical rib 29 in order to provide stiffness to the tongue and support for the back of the wearer's leg.

Within the vamp 17 is an inner liner 31 which provides both fitting and padding functions for the wearer's foot. In the present embodiment, the inner liner 31 extends all the way to the floor of the vamp 17 and covers substantially all of the foot with the exception of that part adjacent the rear opening. A padding member 33 running the substantial length of tongue 27 is also provided within the vamp 19 and is sufficient in length to cover the entire back of the wearer's foot.

Tongue member 27 is adapted to be secured in the closed position by securing means which preferably includes a clamp (not shown) provided near the rear edge of the shell portion 21 adjacent the rear opening 25, a cable loop 35, and a buckle 37. While it is essential to use at least one such securing means, it is preferred to use two, as is illustrated, although more than two may be used if desired.

The buckle 37 is of conventional design, generally having a plurality of slots capable of engaging the cable 35 and a cam-like closing action, wherein the buckle 37 draws the cable 35, under tension, into the closed position. The cable 35 preferably comprises a steel cable made up of fine wires covered with plastic, but it will be obvious to those skilled in the art that it could be a solid wire, and could be fabricated from various metals, plastic, fabric, natural fibers or the like. Preferably the vertical reinforcing rib 29 on the tongue member 27 is provided with two pairs of cable-engaging grooves 39 on its rearmost projection for engaging the endless cables 35 and stabilizing said cables therein.

In accordance with the principles of the present invention, each buckle 37 is pivotally mounted to the ski boot 11 in a buckle stand 41 which releasably mounts to a pad 43 integrally molded with the plastic shell 13.

Figure 2:
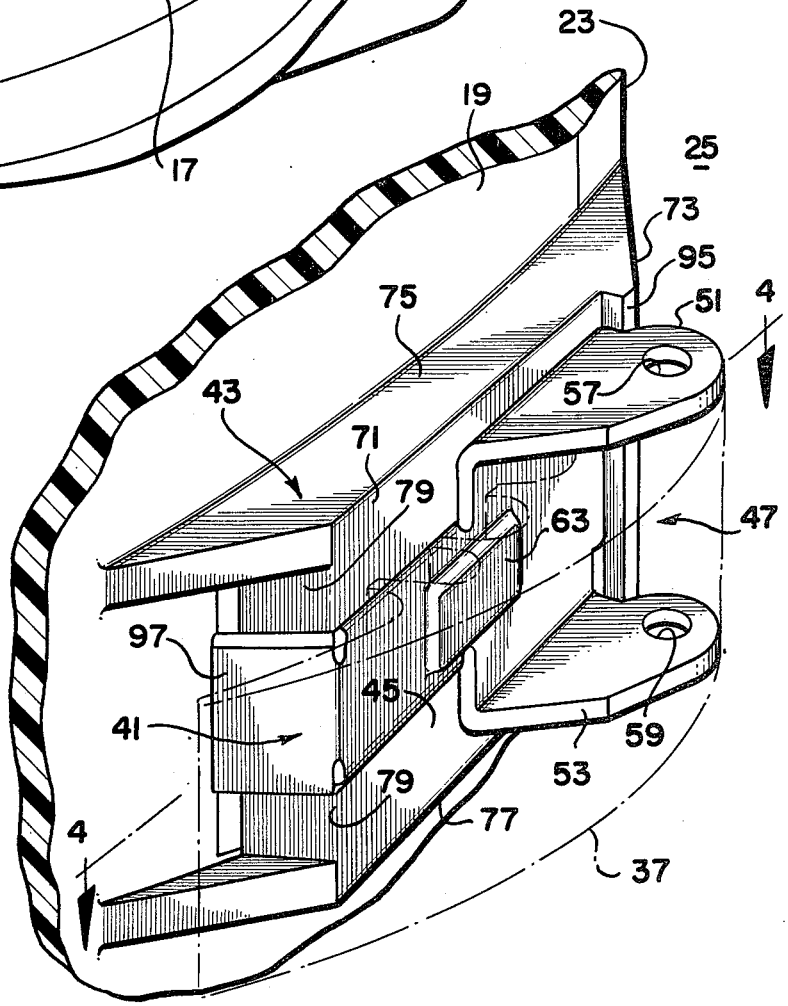
FIG. 2 shows a portion of the ski boot shell which has been enlarged to better illustrate the releasable buckle mounting apparatus.

The buckle stand 41 is preferably of one-piece construction and, for example, may be stamped from 18 gauge stainless steel or the like. Notches 44 may be provided to facilitate bending the stamped piece into its finished shape. As illustrated in greater detail in FIGS. 2 and 3, the buckle stand 41 comprises generally a substantially flat base portion 45 having a yoke portion 47 at one end for pivotally mounting the buckle 37 to the stand 41, and a portion, identified generally at 49, for slidably engaging a complimentary mounting means associated with the pad 43 to mount the buckle stand 41 to the pad 43.

In particular, the yoke 47 comprises a pair of flanges 51, 53 which, referenced to said ski boot, extend outwardly in parallel from the base 45 to accommodate the buckle 37 therebetween. The buckle 37, in turn, is pivotally mounted in the yoke 47 by a pin 55 extending through the shank of the buckle 37 to engage at each end a corresponding one of a pair of holes 57 and 59 through the flanges 51 and 53, respectively. Where as in the present embodiment the width of the buckle shank exceeds the width of the base 45, the portion of the base 45 between the yoke flanges 51, 53 may be correspondingly widened as indicated at 61. Also, a reinforcing rib 63 may be provided as indicated to further strengthen the base 45.

The pad engaging portion 49 by which the buckle stand 41 is secured to the pad 43 comprises a second pair of flanges 63 and 65 which are bent to extend inwardly toward the boot from opposite sides of the base 45. The end of each flange 63, 65, in turn, is bent to have a corresponding foot portion 67, 69, respectively, which extends away from the foot portion of the other flange to engage a corresponding interior surface of the pad 43 and thereby secure the buckle stand to the pad as hereinafter described in greater detail.

Referring also to FIGS. 4 and 5, the pad 43 on which the base stand 41 mounts projects outwardly from the outer surface of the shell 13 to provide a raised, mounting surface 71 which is generally parallel to the outer surface of the shell. The pad 43 is also defined generally by the surfaces 73, 75, 77, 79 extending from the mounting surface 71 toward the outer surface of the shell 13. More particularly, in the present embodiment, the surface 73 slants from the mounting surface 71 to the shell 13, ending at the rear edge 23 of the shell portion, herein 19, immediately adjacent the rear opening 25.

The forward portion of the pad 43 as molded is undercut, as shown generally at 81, to provide an interior pad surface 83. Whereas the outer pad surfaces 73, 75, 77, 79 are formed by the mold used to mold the outer surface of the shell portion, the undercut 81 is provided by appropriate tooling of the inner shell surface mold. Accordingly, in order to provide the undercut 81, a hole 85 is necessarily formed in the wall of the shell 13 by the inner boot mold, the hole 85 being coextensive with but spaced from the interior pad surface 83. This molding technique, however, has the advantage of eliminating the structural weaknesses commonly resulting from the use of molds with backdrafts as heretofore described. The pad 43, as molded, also includes a guide slot 87 extending rearwardly into the pad 43 from the front surface 79 to a point which, in the present embodiment, is approximately half way to the rear of the pad 43 and through the forward portion of the pad from the mounting surface 71 to the interior pad surface 83.

To install the buckle stand assembly to the boot 11, the stand 41 is directed into sliding engagement with the pad 43 from the front such that the flanges 63 and 65 of the stand enter the slot 87 while their respective, oppositely directed foot portions 67 and 69 slide on the interior pad surface 83 on opposite sides of the slot 87. The base 45 slides on the mounting surface 71 of the pad 43. When installed, the base 45 of the stand is held tightly against the mounting surface 71 of the pad by the flanges 67 and 69 which bear against the interior pad surfaces 83 to thereby secure the buckle stand 41 to the mounting pad 43. The buckle stand 41 is prevented from sliding from engagement with the pad 43 by a short, downwardly extending flange 91 which depends from the rear edge of the base 45. When the stand 41 is in place, a second flange 91 resides in a slot 93 provided for that purpose in the mounting surface 71 of the pad adjacent the juncture of the rear surface 73 and the mounting surface 71 and immediately in front of a rib 95. The flange 91, which resiliently slips into a second slot 93 as the stand is slid on to the pad, latches the stand 41 in position and then prevents its accidental release from the pad. The stand 41 can be released by inserting a tool such as the blade of a screwdriver between the rear end of the base 45 and the pad 43 and lifting until the flange 91 is free of the second slot 93 and then sliding the buckle stand assembly forward until it disengages the pad.

In order to prevent snow from entering into the interior of the boot through the hole an opening 85 resulting in the shell 13 when the boot is molded, a third flange 95 slants forwardly from the base 45 toward the shell 13 to close against the front pad surface 79 and thereby block the end of the guide slot 87. Of course, it will be understood that the flange 97 can be extended to also cover the undercut portion of the front surface 79.

Accordingly, the releasable buckle mounting apparatus just described is a significant advance beyond prior releasable buckle mounting apparatus having inherent structural defects resulting from the use of molds having backdrafts and prior art buckle stands which are riveted to the boot. That is, the buckle mounting apparatus of the present invention obviates the use of backdrafts in molding the shell of the ski boot.

While a particular embodiment of the present invention has been shown and described, it will be obvious to those skilled in the art that various changes and modifications may be made without departing from the invention in its broader aspects. Accordingly, the aim in the appended claims in to cover all such changes and modifications as may fall within the true spirit and scope of the invention.

What is claimed is:

1. Apparatus for releasably mounting a closure buckle to the shell of a plastic ski boot comprising:

means including a pad integrally molded with said plastic ski boot and having an outwardly directed exterior mounting surface, said pad having a forward portion which is undercut during molding to provide an inwardly directed interior surface spaced outwardly from said shell but inwardly of said exterior mounting surface and extending rearwardly into said pad, said forward portion having a slot extending rearwardly therein which extends through said forward portion from said exterior mounting surface to said interior surface;

said pad having an opening which extends through the thickness of the boot wall at the location of said slot; and, means including a buckle stand having a base portion and means coupled to said base portion for mounting said buckle, said base portion having a pair of first flanges extending inwardly therefrom toward said shell, each of said inwardly extending first flanges having a foot portion extending therefrom which is substantially parallel to said base portion, said buckle stand being adapted to slidably engage said pad such that said inwardly directed first flanges engage said slot and said foot portions bear against said interior surface to hold and releasably secure said closure member to said pad.

2. Apparatus as claimed in claim 1 including means for latching said buckle stand in position on said pad.

3. Apparatus as claimed in claim 2 wherein said pad has a second slot extending inwardly from said pad exterior mounting surface, and said latching means comprises a second flange extending inwardly from said base to engage said slot when said buckle stand is installed and in position on said pad and prevent said buckle stand from disengaging said pad.

4. Apparatus as claimed in claim 1 wherein said buckle includes a shank portion having a pin extending therethrough, and said means for pivotally mounting said buckle includes a yoke comprising a pair of spaced yoke flanges extending outwardly from said base, each of said yoke flanges having a hole therethrough for accepting said pin to pivotally couple said buckle to said yoke.

5. Apparatus as claimed in claim 1 wherein said buckle stand has a third flange slanting forwardly from said base toward said shell for covering the front of said pad to close said rearwardly extending slot.

6. Apparatus as claimed in claim 1 wherein said shell is molded to have a hole therethrough which is substantially aligned and coextensive with said undercut forward portion, said hole resulting to permit access to said pad from within said shell for molding without backdrafts such that said forward portion is undercut to provide said inwardly directed interior surface.

7. Apparatus as claimed in claim 1 wherein said buckle stand is of one-piece construction and includes means comprising a plurality of notches adapted to facilitate bending said flanges with respect to said base.

8. Buckle closure apparatus for securing a plastic rear-entry ski boot to the foot of a wearer, said ski boot having a shell having a rear opening for providing access to said boot and a tongue for closing said rear opening, said apparatus comprising:

a clamping means mounted on said shell adjacent said rear opening;

means including a cable engaging said clamping means;

a buckle adapted to engage said cable; and, mounting means for mounting said buckle on said shell adjacent said rear opening, said mounting means including a pad extending outwardly from the wall of said ski boot;

said pad being integrally molded with said plastic ski boot to provide an undercut forward portion having an interior surface having a slot extending rearwardly therein, said pad having an opening which extends through the thickness of said boot wall at the location of said slot; and, a buckle stand having means for pivotally mounting said buckle and further having a pair of flanges having respective foot portions extending therefrom for slidably engaging said pad such that said flanges engage said slot and said foot portions bear against said interior surface to secure said buckle stand to said pad, said buckle having a cam-like closing action for tensioning said cable to secure said tongue in said rear opening.

9. A closure assembly for footwear, said closure assembly being adapted to be removably secured to molded footwear, said assembly comprising:

an article of footwear having a wall which includes at least one molded pad which projects outwardly from said footwear wall;

said pad including a first slot which extends along a portion of the length of said pad;

said pad having an opening which extends through the thickness of said footwear wall at the location of said slot;

said pad further including closure member engaging means located along the length of said pad slot for engaging a footwear closure member;

a slidable, substantially rigid closure member comprising a base which is adapted to be seated within said pad slot and substantially extend over the area of said opening, said closure member including foot portion means adapted to be slidably inserted and retained in said engaging means for releasably maintaining said closure member on said footwear pad.

10. A closure assembly in accordance with claim 9 wherein said closure member base includes a first pair of spaced flanges which extend from said base, each of said flanges having a foot portion extending therefrom, and each of said foot portions being adapted to be inserted in said pad engaging means to retain said closure member or in said footwear wall.

11. A closure member in accordance with claim 10 wherein said closure member base further includes a second flange which extends from said base and said pad includes a second slot adapted to receive said second flange so as to maintain said closure member in position on said pad.

12. A closure member in accordance with claim 11 wherein said closure member includes a yoke comprising first and second yoke flanges extending from said base, each of said yoke flanges having means for connecting said closure member to a buckle.

13. A closure member in accordance with claim 9 wherein said closure member includes means extending from said base and substantially covering said opening in said footwear wall.

14. A closure assembly for ski boots, said closure assembly being adapted to be removably secured to molded ski boot, said assembly comprising a molded ski boot which includes at least one pad which projects outwardly from the outer wall surface of said boot, said molded pad being free of backdrafts and including a slot in said pad, said pad further including an opening which extends through the thickness of said pad; and, a slidable substantially rigid closure member having a portion which is adapted to be seated within said slotted pad opening, said portion covering said opening which extends through the thickness of said pad, and said portion including flange members which cooperate with said pad to retain said closure member in said pad.

* * * * *